US006324729B1

(12) United States Patent
Daubenthaler

(10) Patent No.: US 6,324,729 B1
(45) Date of Patent: Dec. 4, 2001

(54) SLIDING ELEMENT FOR A WRIST BAND

(76) Inventor: Andreas Daubenthaler, Bahnhofstrasse 111, D-63177 Maintal (DE)

( * ) Notice: Subject to any disclaimer, the term of this patent is extended or adjusted under 35 U.S.C. 154(b) by 0 days.

(21) Appl. No.: 09/147,005

(22) PCT Filed: Mar. 11, 1997

(86) PCT No.: PCT/EP97/01224

§ 371 Date: Dec. 29, 1998

§ 102(e) Date: Dec. 29, 1998

(87) PCT Pub. No.: WO97/33496

PCT Pub. Date: Sep. 18, 1997

(30) Foreign Application Priority Data

Mar. 11, 1996 (DE) ..... 296 04 439 U
Dec. 24, 1996 (DE) ..... 296 22 428 U

(51) Int. Cl.[7] ..... A44B 11/06
(52) U.S. Cl. ..... 24/182; 24/523; 24/265 WS
(58) Field of Search ..... 368/281–283, 368/285; 40/652, 651, 649, 640; 24/523, 163 K, 182, 183, 265 WS, 32, 68 A, 68 D, 68 R, 573.3, 374, 371, 601.6, 205, 335, 685 K, 685 B, 657; 267/74

(56) References Cited

U.S. PATENT DOCUMENTS 1,398,483 * 11/1921 Curtis ..... 24/523 X
3,049,774 * 8/1962 Rhodes et al. ..... 267/74
4,170,808 * 10/1979 Knowles ..... 24/163 K

FOREIGN PATENT DOCUMENTS

1956106 * 5/1971 (DE) .
826561 * 4/1938 (FR) .

* cited by examiner

*Primary Examiner*—James R. Brittain

(57) ABSTRACT

The invention concerns a sliding element (110) for a wrist band, in particular a wrist-watch band, the sliding element extending along the front face of the wrist band and at least in sections along the rear face of the wrist band. The sliding element comprises a substantially cuboid base element (112) which extends along the front face of the wrist band and has guides (142) projecting from the base element for holder elements (114, 116) which are displaceable relative to the base element and the wrist band and each engage about a longitudinal edge of the wrist band. The sliding element (110) further comprise spring elements (126, 128) which extend in the sliding direction of the holder elements (114, 116) and are supported on sections of the base element and the holder elements.

13 Claims, 2 Drawing Sheets

Figure 4:
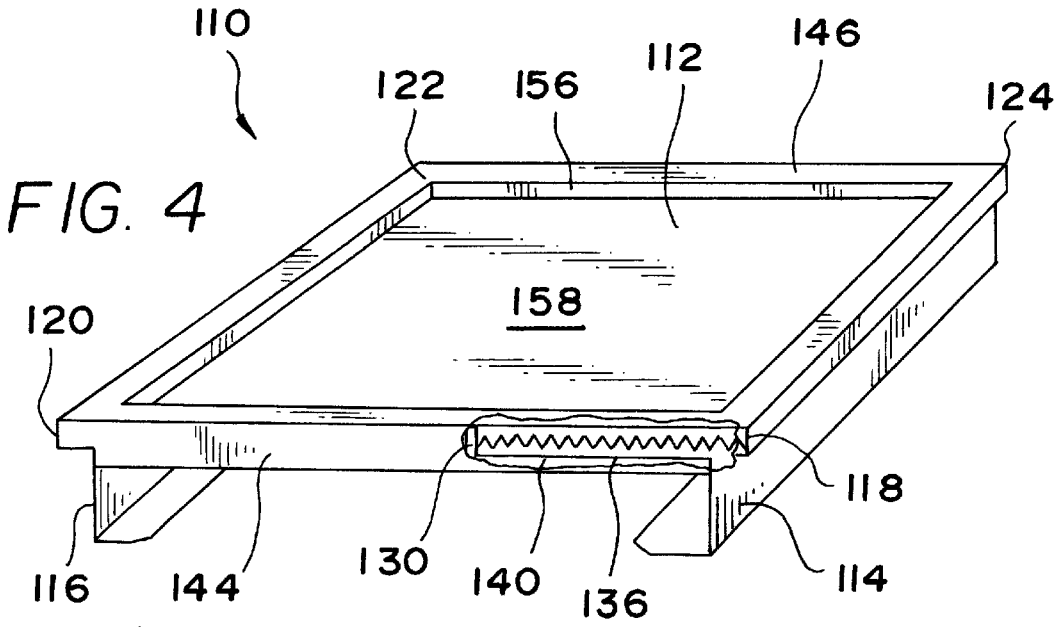

FIG. 1
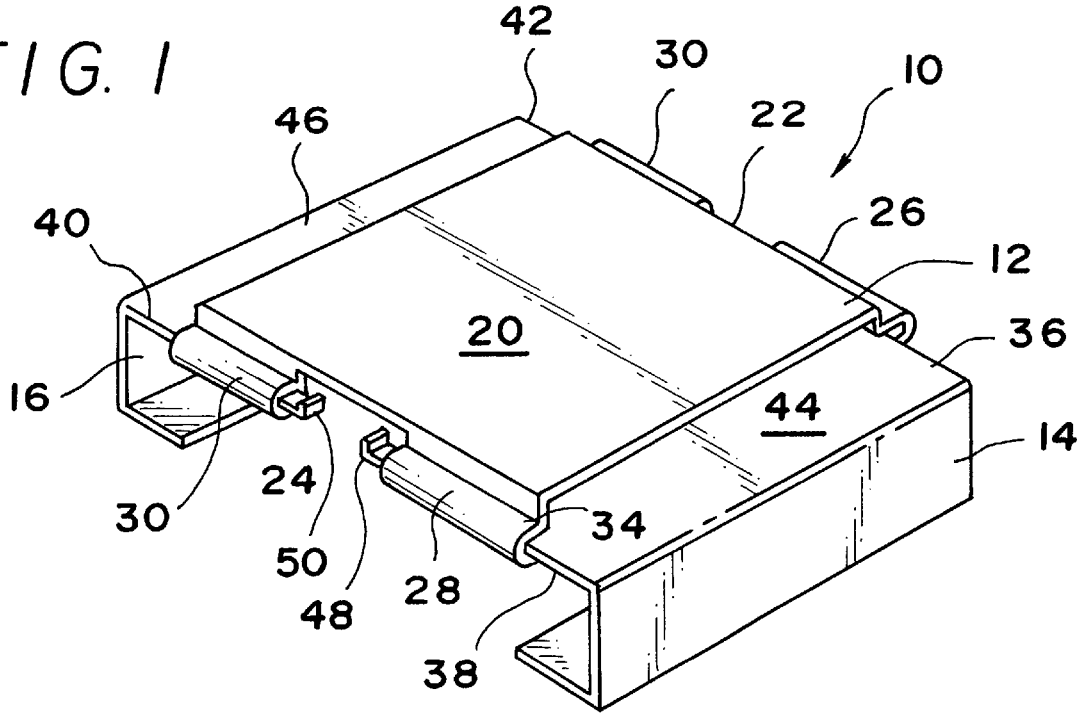
FIG. 2
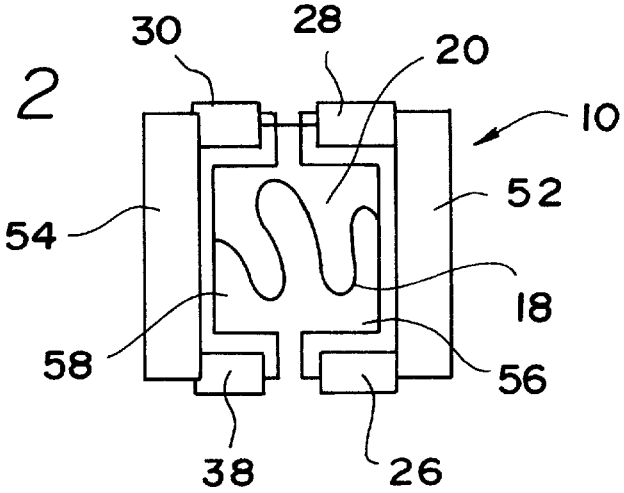
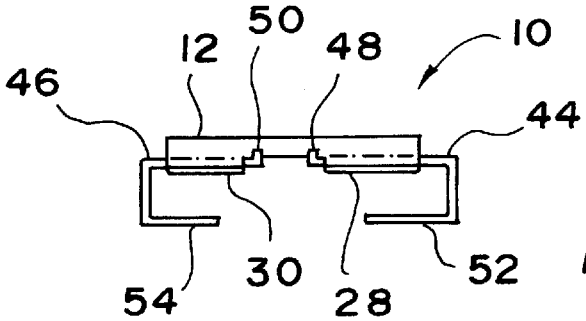
FIG. 3

SLIDING ELEMENT FOR A WRIST BAND

The invention relates to a sliding element for a strap, in particular a strap for a wrist watch, which extends along the front of the strap, and at least in sections along the back of the strap.

A corresponding sliding element can be inferred, for example, from DE-GM 1 944 541. In this case the sliding element is embodied as an inscription carrier and has projecting strip-shaped tongues, which must be bent in accordance with the width of the strap and then extend along the underside of the strap.

Such a sliding element is not designed for being exchanged, or respectively to be fastened to different straps of widths which differ from each other, since in this case the tongues would break off.

An ornamental element for strip-shaped designed straps is known from DE 93 11 618 U1, which consists of a U-shaped base element, which can be locked by means of a pivotably movable leg. Individual matching to straps of different widths is not possible.

The present invention is based on the object of further developing a strap of the previously described type in such a way that it can be used independently of the width of the strap, but without having to forego an exactly fitting seating.

In accordance with the invention, this object is essentially attained in that the sliding element comprises a base element, which extends along the front of the strap, is essentially flat and has holding elements extending therefrom, which are displaceable in relation thereto, which respectively extend around a longitudinal edge of the strap and rest against it, regardless of the width of the respective strap, wherein the holding elements are spring-loaded either in respect to the base element or to each other.

The invention is particularly distinguished by a sliding element for a strap, in particular a strap for a wrist watch, which extends along the front of the strap, and at least in sections along the back of the strap, comprising a base element, which extends along the front of the strap, is essentially flat and has guides extending therefrom for holding elements, which are displaceable in relation to the base element and the strap, and which respectively extend around a longitudinal edge of the strap, as well as spring elements extending in the sliding direction, which are supported on sections of the base element as well as of the holding elements.

An automatic adaptation of the distance of the holding elements as a function of the width of a strap is possible because of the relative displaceability between the base element and the holding elements and the springs, in particular helical springs, cooperating with them, so that an exactly fitting seating is provided. Here, the sliding element can be arbitrarily exchanged and fastened to straps of different widths without its ability to function being interfered with or the exact fit being lost.

It is preferably provided that the holding element has a U-shape, whose transverse leg extends along the front of the strap, whose one first lateral leg extends parallel with and on the underside of the base element, and whose further second lateral leg extends on the underside of the strap, wherein a detent for a spring element, which extends along the respective outer edge of the first transverse leg, extends from the respective outer edge of the first transverse leg into the guide.

Preferably the guide comprises a transverse edge of the base element beveled in an L-shape, which in particular is beveled all around and whose edge receives a depression for receiving an insert.

Here, the beveled edge preferably extends in a plane, in the underside of which the depression of the base element lies.

In a further development of the invention it is provided that in cross section the guide is circularly embodied and is a receptacle for the spring elements, preferably in the shape of helical springs. It is in particular provided that, with the spring elements relaxed to a large degree, the detents of the first lateral legs rest against each other, while the outer edges of the lateral legs preferably extend at a distance from each other.

The respective helical springs are supported on the one side against a beveled edge section of the base element and on the other side at the detent extending from the holding element, wherein in particular a spring element extends from the respective corner area of the base element. In this way equal forces act on the holding elements, which are U-shaped in cross section, but have lateral legs of different length, which make a tilt-free displacement possible.

In accordance with the invention, a sliding element is proposed, which consists of elements which can be displaced in respect to each other, because of which an individual adaptation to straps of different widths is possible. In the process, an automatic adaptation to the strap width takes place in that the holding elements are provided with a prestress toward each other by means of compression springs, wherein the compression springs in the form of the helical springs themselves run in guides formed by sections of the base element.

As a result there is a closed unit constituting the sliding element without the loosening of screws or the like being required for providing a width adaptation.

In place of a helical spring embodied as a compression springs, it is of course possible to employ a tension element, such as an extension spring, by means of which the holding elements are also moved toward each other.

Therefore the invention is also distinguished in that the holding elements are connected with each other by means of a tension element, such as an extension spring, wherein the tension element is covered by the base element itself.

In further development of the invention it is provided that the holding element, which outside of the base element has an approximately U-shape, has an outer leg which, on the side of the base element, extends parallel with the base element, whose respective longitudinal edge is respectively received in a guided manner by a beveled edge section of the base element.

In other words, the holding elements are arranged displaceably in edge areas of the base element, wherein the length of the longitudinal edges of the base element which receives the holding elements should be selected to be such, that tilting is impossible.

In order to prevent the uncontrolled removal of a holding element out of the guide constituted by the base element, a further development of the invention provides that the longitudinal edge of the holding element on the side of the base element has on its end a section rolled off in the direction of the base element, such as a lug, which is used as a detent for the base element, namely its edge section, U-shaped in cross section, which receives the holding element.

In order to provide a closed surface of the base element, which can be used as a support for ornamental elements, engravings or the like, it is furthermore provided that the edge section receiving the longitudinal edges of the outer legs on the base side makes a transition via respectively one step into the section, which extends flat along the strap which, as has been mentioned, provides the function of a support.

In order to make the sliding element light in structure, without having to accept losses regarding stability, it is furthermore provided that the outer legs on the side of the base element, starting at their lateral edges, respectively have a rectangular-shaped cutout, which is covered by the base element, i.e. cannot be seen from the direction of the top of the sliding element.

Further details, advantages and characteristics of the invention ensue not only from the claims, the characteristics to be taken from them—by themselves and/or in combination—but also from the following description of a preferred embodiment to be represented in the drawings.

Figure 5:
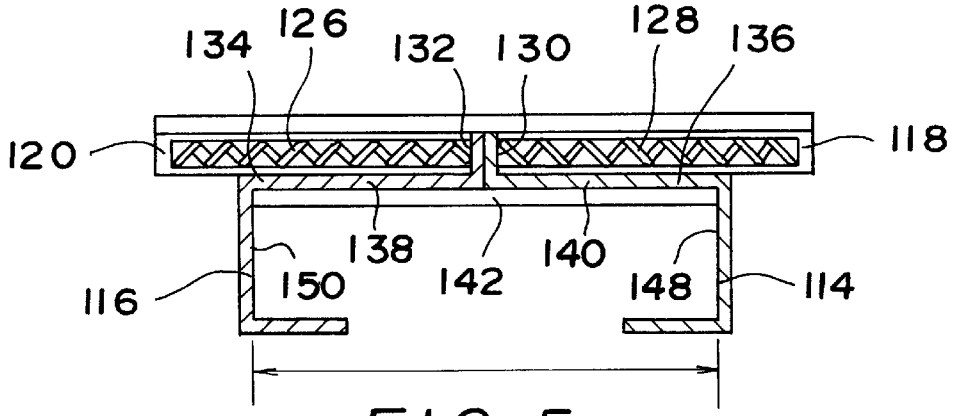
Figure 6:
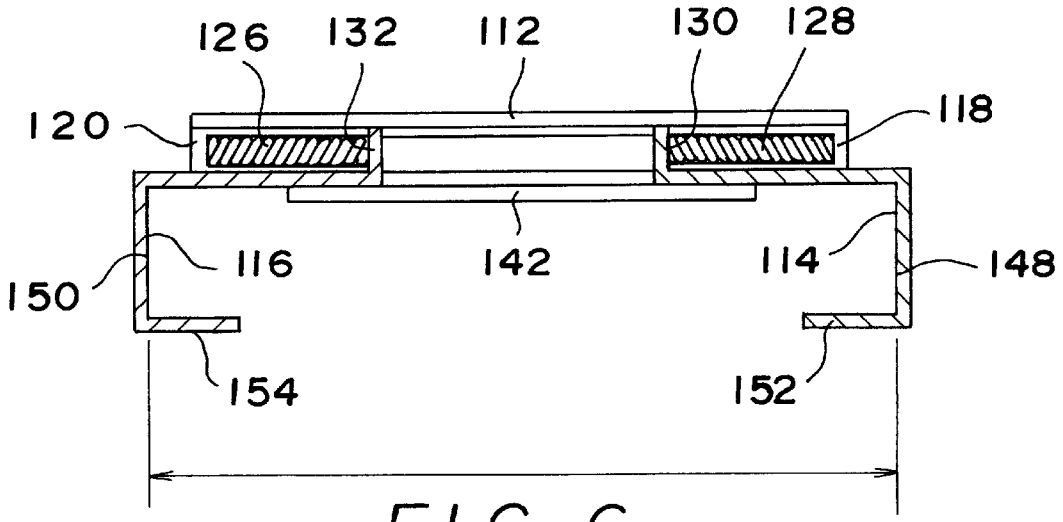

Shown are in:

FIG. 1 a perspective view of a sliding element,

FIG. 2 a view from below on the sliding element in FIG. 1,

FIG. 3 a lateral view of the sliding element in FIG. 1, or respectively FIG. 2, FIG. 4 a perspective view of a second embodiment of a sliding element, FIG. 5 a cross section through the sliding element in accordance with FIG. 4 perpendicularly in relation to the longitudinal direction of a strap with the guiding elements compressed, and FIG. 6 a cross section corresponding to FIG. 5, but with the guiding element stretched out.

A first embodiment of a sliding element in accordance with the invention, which can be slid on a strap, in particular a strap for a wrist watch, is represented purely in principle in FIGS. 1 to 3, wherein the adaptation of the width of the sliding element 10 to the width of the strap takes place automatically.

Actually, the sliding element 10 consists of four elements, namely a base element 12, two holding elements 14 and 16, extending along the longitudinal edges of a strap, not represented, and therefore extending around the strap, and a tension element connecting them, such as an extension spring 18.

The base element 12 has a flat front plate 20, which is embodied as a support, for example for an ornament, or as an engraving surface. The plate-shaped section 20 here extends on the upper surface of the watch strap and can be visually seen.

Beveled edge sections 26, 28, 30 and 32 extend from the longitudinal edges of the plate-shaped section 20. In cross section, the edge sections 26, 28, 30 and 32 have a U-shape and are used as a guide and receptacle for the holding elements 14 and 16.

Here, the beveled edge sections 26, 28, 30 and 32 are arranged to extend offset in respect to the plate-shaped base section 20, so that a step, which itself has been provided with the reference numeral 34 by way of example, is formed between the sections 26, 28, 30 and 32 and the plate-shaped section 20.

Longitudinal legs 36, 38, 40 and 42 of the outer leg 44, 46, located on the side of the base element, of the holding element 14, or respectively 16, extend inside the guide 26, 28, 30 and 32. The longitudinal legs 36, 38, 40 and, are bent over at the ends, thus they have a lug 48, 50 angled in the direction of the plate-shaped base section 20, by means of which a limit to the displacement of the holding legs 14, 16 towards the base element 12 is provided.

The holding legs 14, 16, which have a U-shape in cross section, wherein the outer leg 52, 54 extending along the underside of the strap has a shorter length than the respective leg 44, 46 extending along the upper surface of the watch strap. The holding legs 14, 16 can also be described as comprising a first planar portion 44, 46 each having a depending L-shaped leg.

The outer legs 44, 46, located on the side of the base element, of the holding elements 14, 16 have rectangularly-shaped cutouts 56, 58, made clear by the view from below in the representation in FIG. 2. The tension element, or respectively the extension spring 18, extends inside these cutouts, wherein the width of the tension element 18 should be approximately that of the thickness of the outer legs 44, or respectively 46.

A second embodiment of a sliding element 110 in accordance with the invention, or respectively its principal construction, which can be slid on a strap, in particular a watch strap, is represented purely in principle in FIGS. 4 to 6, wherein the adaptation of the width of the sliding element 110 to the width of the strap takes place automatically (FIGS. 5 and 6).

Actually, the sliding element 110 consists of a base element 112 extending along the upper surface of the strap, two holding elements 114, 116, which extend around the strap along its longitudinal edges and are essentially U-shaped in cross section, as well as spring elements in the form of helical springs acting on these, which respectively extend from a corner area 118, 120, 122, 124 of the base element 112 and which are provided with the reference numerals 126 and 128 by way of example in the sectional representation of FIGS. 5 and 5.

In other words, the helical springs 126, 128 are supported at one end on the inside in the corner area 118, 120, 122 and 124, and at the other end on stops or protrusions 130, 132, which extend from the respective inner lateral leg 134, 136, namely from its respective outer edge 138, 140.

In its longitudinal area the lateral leg 134, 136 is received in guides 142, which are formed from sections of the base element 112, namely its beveled transverse edges 144, 146. Here, the guides 144, 146 show a section of a circle in cross section, within which the helical springs 126, 128, the same as the longitudinal edges 138, 140 of the inner lateral leg 134, 136, extend in a guided manner.

In other words, compression springs 126, 128 act on the stops 130, 132 of the holding elements 114, 116, because of which the holding elements are moved toward each other and—as made clear in FIG. 5—with the helical springs 125, 128 almost relaxed, the stops 130, 132 meet each other. The minimal distance between the transverse legs 148, 150 of the holding elements 114, 115 is set by this. The maximum distance between the transverse legs 148, 150 can be seen in FIG. 6. This state is achieved when the helical springs 126, 128 are maximally compressed, so that their material is completely compressed between the edge areas 118, 120, or respectively 122, 124 of the base element 112 and the stops 130, 132.

The remaining outer lateral leg 152, 154 of the holding element 114, 116 extends underneath the strap, not represented, so that the required fastening of the sliding element 110 itself is assured.

As the perspective representation in accordance with FIG. 4 makes clear, the edge of the base element 112 is beveled, so that the approximate geometry of a truncated pyramid with convexly outward bent outer surfaces results. On the top, the base element 112 has a circumferential edge 156 surrounding a depression 158, into which an insert, such as an ornamental element, a data carrier, or the like can be placed.

The sliding element 110 can be made of a precious metal or of sheet metal and it can be a deep-drawn element in respect to the base element 112. When using sheet metal, material thicknesses of, for example, 0.4 mm thickness, can be used without the required stability being lost. This is assured by the beveling of the edges and the formation of the depression 158.

The helical springs 126, 128 used can, for example, have a diameter of 1.8 mm and a length of 9 mm in the compressed state. The depression, or respectively receptacle 158 can extend, offset by, for example 1 mm, in relation to the circumferential edge 156.

What is claimed is:

1. A sliding element for a strap, which extends along the front of the strap, and at least in sections along the back of the strap, comprising a base element which extends along the front of the strap, and is essentially flat, first and second holding elements extending from said base element and displaceable in relation to said base element, said first and second holding elements respectively extending around a longitudinal edge of the strap and resting against it, regardless of the width of the respective strap, wherein the first and second holding elements are spring-biased by a tension element either in respect to the base element or to each other and wherein the tension element (126, 128) is supported in a corner area of the base element.

2. The sliding element in accordance with claim 1 characterized in that the base element is raised around its circumference, and that a top edge of the base element surrounds a depression for receiving an insert.

3. The sliding element in accordance with claim 1, characterized in that said first holding element and said second holding element include opposed stops and, with the tension element relaxed, the stops rest against each other.

4. The sliding element in accordance with claim 1, characterized in that each of said first and second holding elements has an outer leg extending parallel with the base element (12) on a first side of the base element, each of said outer legs having a longitudinal edge received in a guided manner by an L-shaped edge section of the base element.

5. The sliding element in accordance with claim 1, characterized in that the longitudinal edge of said holding element has a lug (48, 50) angled in the direction toward the base element at its end.

6. The sliding element in accordance with claim 5, characterized in that the edge section, which receives the longitudinal edge (44, 46) of the outer leg (44, 46) of the holding element on the side of the base element, makes a transition by means of a step into a section of the base element; which section extends flat along the front of the strap and in a top view is rectangular.

7. The sliding element in accordance with claim 6, characterized in that starting from a transverse edge, the outer leg of the holding element has on the side of the base element a rectangular cutout, covered by the base element.

8. The sliding element in accordance with claim 7, characterized in that the tension element, comprises an extension spring extending inside the rectangular cutout and having a width which approximately corresponds to the thickness of the outer leg of the holding element on the side of the base element.

9. A sliding member for a strap comprising:

a planar base element having first and second opposed sides, a first guide mounted proximate said first side and a second guide mounted proximate said second side;

a first holding element having a planar portion and an L-shaped leg connected to said planar portion, the planar portion of said first holding element slidably mounted in said first guide;

a second holding element including an L-shaped leg mounted in said second guide; and, spring means for biasing the L-shaped leg of said first holding element toward said base element;

wherein the distance between said first and second guides is greater than the distance between said first and second opposed sides of said base element.

10. The member of claim 9 wherein said second holding element is slidably mounted in said second guide.

11. The member of claim 9 wherein said planar portion of said first holding element includes a central portion and first and second leg portions extending perpendicularly therefrom, said first and second leg portions being received in said first and second guides.

12. The member of claim 11 wherein said first guide comprises an interior portion of said base element and said first and second holding members each include a stop extending into said base element.

13. The member of claim 11 wherein said spring means comprises a first spring connected between said base element and said first holding element stop and a second spring connected between said base element and said second holding element stop.

* * * * *